United States Patent [19]

Carlson

[11] 4,137,955

[45] Feb. 6, 1979

[54] TAMPERPROOF SHIPPING VALVE

[75] Inventor: Richard W. Carlson, Warwick, N.Y.

[73] Assignee: International Paper Company, New York, N.Y.

[21] Appl. No.: 801,831

[22] Filed: May 31, 1977

[51] Int. Cl.[2] ..... B65B 3/04; F16K 13/04

[52] U.S. Cl. ..... 141/349; 137/68 R; 137/614.04; 141/362; 217/99; 222/541

[58] Field of Search ..... 137/68 R, 71, 614.02, 137/614.03, 614.04; 141/18, 329, 330, 348–353, 360–362, 383, 386; 217/99; 222/501, 541

[56] References Cited

U.S. PATENT DOCUMENTS 3,326,226 6/1967 Hinton ..... 137/68 R

*Primary Examiner*—Richard E. Aegerter
*Assistant Examiner*—Frederick R. Schmidt
*Attorney, Agent, or Firm*—James F. Haley, Jr.

[57] ABSTRACT

A disposable tamperproof shipping valve for containers of fluids, especially those under pressure. The valve of unitary, one-piece construction incorporates a tamperproof, hermetic seal and includes a means for opening a check valve in an external dispenser for fluid flow control. It is amenable to ready insertion into the filling opening of a fluid shipping container. There, the valve remains sealed until the sealing ring is broken for fluid dispensing and consumption or use.

12 Claims, 5 Drawing Figures

TAMPERPROOF SHIPPING VALVE

BACKGROUND OF THE INVENTION

This invention pertains to the valve art. More particularly, it is directed at providing an inexpensive, disposable, tamperproof shipping valve for containers of fluids, especially those under pressure.

Many fluids, such as soft drink syrups, carbonated beverages or beers, chemicals, and gases or other liquids, commonly are shipped to the point of consumption or use in stainless steel shipping dispensers. Such containers are there mated with myriad external dispensing lines and delivery of fluid afforded on demand. Until such connection, they must remain hermetically sealed to avoid contamination of the contents. Hence, any degradation of this airtight seal during shipment, albeit to be avoided, must be easily recognizable. Seals, characterized by this property, are termed "tamperproof". Any tampering with or damage to such seals is apparent prior to dispensing means connection. Thus, mistaken use of contaminated fluids can be prevented by simple observation.

These commonly used metal shipping containers are very costly to purchase. Moreover, they require return and difficult, time consuming cleaning prior to refilling for reuse. A one-way throw-away shipping container is needed to replace such metal dispensers. Some of these are now known, for example those of U.S. Pat. Nos. 2,261,621, 2,623,443, 2,623,445, 3,178,088, 3,428,239 and 3,608,771 and British Pat. Specification No. 428,909. However, any economy fostered by the use of such disposable shipping containers has been substantially blunted by that attendant expense associated with the standard sealing and connecting valves used therein.

These prior valves, commonly used to connect the shipping container to the check or relief valve of an external dispensing means, are of four-piece construction. They include a valve housing, a spring, a spring-loaded means for releasing the check or relief valve for delivery flow control, and a restraining washer to position the spring and releasing means for ultimate connection. Further, these valves are not in themselves tamperproof. They must be capped with an additional or fifth tamperproof piece to display this important attribute of any shipping container. Removable tamperproof caps useful for this purpose are disclosed for example in U.S. Pat. Nos. 3,567,061 and 3,608,771.

Other connecting valves, well known in the art, do not avoid this complex construction so as to be useful as both a disposable tamperproof seal and check valve release means in fluid shipping containers. Some of these valves, such as those disclosed in U.S. Pat. Nos. 2,947,315, 2,958,545 and 3,141,470, albeit tamperproof, are of complex construction and do not provide a check valve releasing means. Others such as those of U.S. Pat. Nos. 2,586,858, 2,814,418, 3,116,747, 3,158,165, 3,195,779, 3,592,351, 3,762,606 and 3,884,387 are of simple construction but provide only container sealing or resealing. None avail tamperproof sealing and release of check valve dispensing means.

SUMMARY OF THE INVENTION

Accordingly it is an object of this invention to provide a disposable shipping valve for fluid containers, particularly pressurized shipping containers. This valve, of unitary and simple construction, is both tamperproof and providing of a check valve releasing means to control fluid flow through an external dispensing means for consumption or use.

The valve is designed for easy connection to the collar defining that orifice used for filling the disposable shipping container. Further, its opposite end is amenable to ready connection with standard external check valve dispensers to form a leak proof seal and permit fluid delivery.

It is another object of this invention to provide a shipping valve such that insertion to a check valve type dispensing means both breaks the shipping valve's sealing membrane and provides that properly positioned check valve releasing means to allow fluid flow control from the shipping container through the dispenser for ultimate delivery.

DESCRIPTION OF THE PREFERRED EMBODIMENTS

Figure 1:
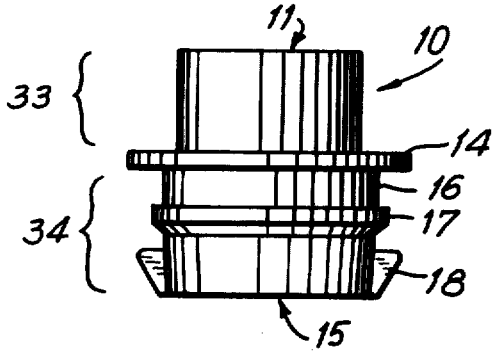
FIG. 1 is a side view of the shipping valve of this invention.

Referring to FIG. 1 of the drawings, there is shown therein a preferred shipping valve 10 of the present invention. The valve is preferably made by single operation molding of extrudable material. The particular composition employed, while usually polyethylene, is primarily dependent on the fluid contained in the shipping container and its expected use. Those skilled in the art will recognize the selection of specific materials from such extrudable class so as to attain desired odor protection, oxygen barrier, or resistance to dissolution or decay.

Figure 3:
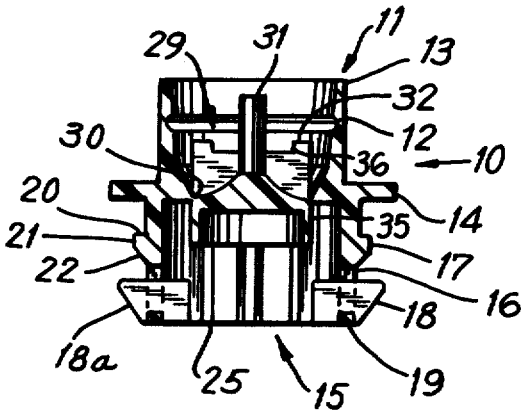
FIG. 3 is a section view along line 3—3 of FIG. 2 of the shipping valve of this invention.

The integral valve 10 includes a top portion 33, bottom portion 34 and break-away member 29 (best shown in FIG. 3). The top and bottom portions are open-ended axial casings. They are integrally connected end on to an intermediate flange member 14. This connection maintains a channel extending from the unconnected end of the top portion to the unconnected end of the bottom portion. The break-away member is made integral with the top portion by a membrane or rupturable sealing surface. This integral member affords a hermetic, tamperproof sealing of that channel formed by the top and bottom portions and intermediate member.

The integral top portion comprises an open-ended axial casing and a means for sealably connecting one end of the casing to an external dispensing means. While the casing may be of any geometry it is preferably circular. As best shown in FIGS. 1 and 3 such circular casing includes an orifice 11 and side walls 13.

The means for connecting one end of the casing, i.e. orifice 11, to an external dispensing means may be any well known sealing means. It is preferably a continuous cut-out in the inside walls of the axial casing, parallel to the orifice 11. This cut-out in the preferred embodiment of FIG. 3 is annular ring 12. Such cut-out is shaped so as to correspond with a member on the outside walls of the connecting portion of the external dispensing means.

Figure 5:
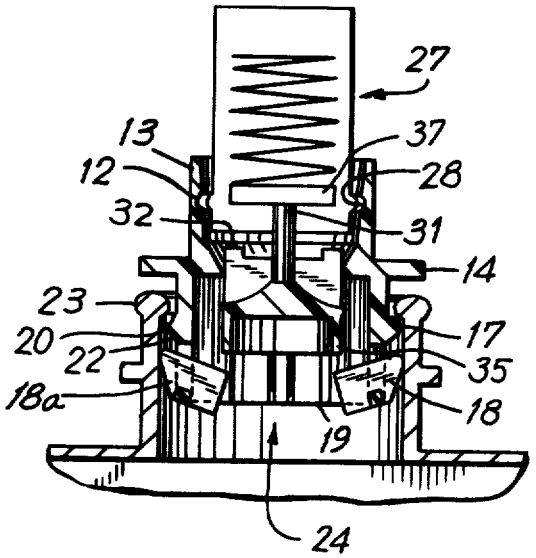
FIG. 5 is a section view of the shipping valve of this invention as connected between a shipping container and an external check valve dispensing means.

The mating of these related forms effects a liquid-tight seal of valve 10 to an external dispensing means. This connection is best illustrated in FIG. 5.

Within top portion 33, the inner surfaces of side walls 13 preferably slope inwardly to narrow the original orifice 11. This narrowing, shown in FIG. 3, terminates in sealing surface 30, an integral part of the side walls. The sealing surface hermetically connects the inner side walls to break-away member 29. Surface 30 is of membrane thickness, i.e. in the range of about 0.003 to about 0.15 inches. It provides a tamperproof seal for the valve yet permits ready rupture for delivery. This break-away is preferably effected by dispenser means insertion into top orifice 11.

The break-away member is usually of the same geometry as the top axial casing. It is however to be understood that it may be of different geometry so long as it may be integrally sealed to the top casing. The member comprises a base and a check valve releasing means thereon, the releasing means extending in a direction toward the end of the top portion to be connected to an external dispensing means. Preferably, this check valve releasing means is an axial stem located on the base. More preferably the member also includes means for aiding the break-away and rupture of that sealing surface connecting it to the side walls of the top portion of the shipping valve. Such unsealing is most preferably effected by insertion of the dispensing means into orifice 11.

Figure 2:
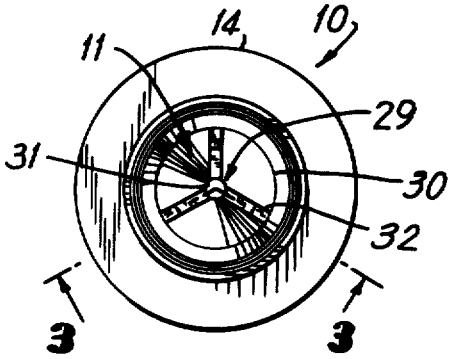
FIG. 2 is a top view of the shipping valve of this invention.

Referring to FIG. 3, a preferred embodiment of this break-away member is shown. There, check-valve releasing means, axial stem 31, is located on circular base 35, the base being sealed to the top portion through sealing surface 30. In this embodiment the means for aiding the break-away are a plurality of radial fins 32 (FIG. 2) located about stem 31 and extending outward therefrom to the circumferential edge of base 35. The radial fins, while of non-critical shape, must not interfere with the check valve releasing function of the break-away member. As depicted in FIG. 3 they preferably have a step-like top edge 36.

As best shown in FIG. 5, the break-away member, particularly check valve releasing stem 31, after orifice 11 connection to external dispensing means 27 and attendant seal 30 rupture and break-away, acts to hold open check valve 37 of the dispensing means. This permits fluid flow control during delivery for use and consumption.

The integral bottom portion of valve 10 comprises an open-ended axial casing; a means for sealably connecting one end of the casing to an orifice of a shipping container; a stopping means for preventing the break-away member from falling into a connected shipping container after break-away, and a means for positioning the check valve releasing means of the break-away member so as to release the check valve of a connected external dispensing means.

The axial casing may be any convenient geometry and shape. Like the top portion, it is preferably a circular tube, whose diameter may be greater than that of the top portion.

While the means for sealably connecting one end of the casing to an orifice of a shipping container may be any number of well-known connecting means, it is preferably a continuous member integral with the walls of the axial casing and parallel to the end thereof. This member is most preferably formed to snap-fit onto the container orifice.

The stopping means for preventing the break-away member from falling into the shipping container and the positioning means for the check valve releasing means are on noncritical shape. However, they must not substantially hinder fluid flow through the valve during delivery from the shipping container to the dispensing means. Preferably, a single means performs both functions.

A preferred embodiment of such bottom portion 34 is illustrated in FIG. 3. There, the open-ended axial casing is a tube of orifice 15 and side walls 16. Sealing means 17, an annular member in the outer walls of this tube effects connection with lip 23 of orifice 24 of the shipping container (FIG. 5). In this embodiment, the annuar member is defined by horizontal top surface 20, joined vertical side surface 21 and joined inward sloping surface 22 making an acute angular connection with side wall 16. This member permits snapfitting of the valve 10 onto the lip 23 of orifice 24 of a shipping container (FIG. 5).

The preferred unitary stopping and positioning means comprises a pair of diametrically opposed dog ears 18 and **18*a* embraced in side walls 16. These ears are preferably located near the bottom edge 19 of the side walls. They extend freely through the side walls and are attached at only about the bottom edge thereof. This hinge-like connection permits ears 18 and 18*a* to pivot to some degree about this edge in a direction parallel to the side walls. Such movement allows the valve to be inserted into the filling opening of a shipping container without dog ear interference. Their position after insertion is best depicted in FIG. 5. There the dog ears prevent the break-away member 29 from falling onto the shipping container subsequent to rupture of sealing surface 30. Moreover, the dog ears act as a preferred positioning means to position the released member such that stem 31 functions to open check valve 37 of connected dispensing means 27**.

Figure 4:
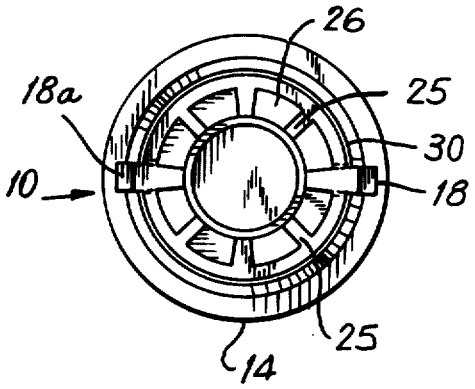
FIG. 4 is a bottom view of the shipping valve of this invention.

The inner sides of bottom side walls 16 also preferably encompass a plurality of ribs 25, best shown in FIG. 4. These ribs define a series of channels 26 for fluid dispersement through valve 10 from the shipping container to an external dispensing means.

Although the intermediate member integrally linking the top and bottom portions of the valve end on and maintaining a channel through such portions may be of any convenient form, it is preferably a flange having a cut-out central portion to provide the required open channel. Referring to FIG. 1, the top valve portion 33 is integral with one side of flange 14 and the bottom valve portion is integral with the opposite side of flange 14. This flange may act to seat lip 23 of shipping orifice 24 on sealing means 17. However, other seating means such as those depicted in FIG. 5 may be employed.

Referring to FIG. 5, this preferred flange 14 acts seat lip 23 of shipping orifice 24 on sealing means 17.

It will be seen that the shipping valve of this invention provides an efficient and economical means for the tamperproof sealing of a disposable container. It also affords a check valve releasing means on connection to a dispensing means. It is disposable, may readily be connected to the filling opening of a shipping container, and provides an orifice for each reception of a dispensing means.

While we have hereinbefore presented a number of embodiments of our invention, it is apparent that our basic construction can be altered to provide other embodiments which utilize our invention. Thus, it will be appreciated that the scope of our invention is to be defined by the claims appended hereto rather than the specific embodiments which have been presented hereinbefore by way of example.

I claim:

1. A one-piece shipping valve comprising:

a. an integral top portion comprising an open-ended casing and a means for sealably connecting one end of said casing to an external dispensing means, the dispensing means including a check valve;

b. a break-away member comprising a base and a check valve releasing means thereon, said check valve releasing means extending toward said one end of said casing of the top portion and said break-away member being positioned within said casing of said top portion and integrally connected to the inside of said casing through a break-away sealing surface, the sealing surface being rupturable, so as to permit separation of said break-away member from the inside of said casing, on connection of said one end of the casing to the external dispensing means;

c. an integral bottom portion comprising an open-ended casing; a means for sealably connecting one end of said casing to an orifice of a shipping container; a stopping means for preventing said break-away member from falling into a connected shipping container after its separation from the inside of the casing of the top portion; and a means for positioning said check valve releasing means of said break-away member after its separation from the inside of the casing of the top portion so as to release the check valve of a connected external dispensing means; and d. an intermediate member integrally linking the other end of the top casing and the other end of the bottom casing, said connection maintaining a channel between the two portions.

2. The valve of claim 1 wherein said means for sealably connecting one end of said casing to an external dispensing means comprises an annular cut-out member in the inside walls of said casing and parallel to said one end thereof.

3. The valve of claim 1 wherein said break-away member includes a means for aiding the rupture of said break-away sealing surface.

4. The valve of claim 3 wherein said check valve releasing means is a stem located in the center of said break-away member base.

5. The valve of claim 4 wherein said means for aiding said rupture are a plurality of radial fins extending outwardly from said axial stem to the edge of said base, said fins being non-interfering with said axial stem.

6. The valve of claim 1 wherein said intermediate member is a flange, said flange having a cut-out axial portion to maintain said channel between the linked portions.

7. The valve of claim 1 wherein said means for sealably connecting said one end of said casing to an orifice of a shipping container comprises an annular member on the outer walls of said casing for snap-fitting to said orifice of said shipping container.

8. The valve of claim 1 wherein said stopping means and said positioning means are unitary.

9. The valve of claim 8 wherein said unitary stopping and positioning means comprise a pair of diametrically opposed dog ears, said dog-ears being hinged near said one end of said casing and freely extending through the walls of said casing sufficiently to prevent said check valve releasing means from falling into said container after break-away.

10. A one-piece shipping valve comprising:

a. an integral top portion comprising an open-ended axial tube and an annular cut-out member located in the inner side walls of said tube for connecting one end of said tube to an external dispensing means, the dispensing means including a check valve, the inner side walls of said tube sloping inwardly from said one end and ending in a break-away sealing surface at the other end and the outer side walls of said tube being vertical;

b. a break-away member comprising a circular base; an axial check valve releasing stem thereon; and a plurality of radial fins extending outwardly from said axial stem to the circumferential edge of said base, said check valve releasing stem extending toward said one end of the axial tube of the top portion, said radial fins being non-interfering with said axial stem, and said base being axially positioned within said axial tube of the top portion and integrally connected thereto through said break-away sealing surface, the sealing surface being rupturable, so as to permit separation of said base from the axial tube, on connection of said one end of the axial tube to the external dispensing means;

c. a bottom portion comprising an open-ended axial tube; an annular member encircling the outer side walls of said tube and providing a snap-fit connection of one end of said tube to the orifice of shipping container; and a pair of diametrically opposed dog ears, being hinged near said one end of said tube and extending freely through said tube sufficiently to prevent said break-away member from falling into said container after its separation from the axial tube of the top portion and to position said check valve releasing stem after separation of the break-away member from the axial tube of the top portion so as to release the check valve of the connected dispensing means; and d. an intermediate flange integrally linking said other end of said top portion and said other end of said bottom portion, said connection maintaining an axial channel between the two portions.

11. In a disposable shipping container for holding fluids under pressure a tamperproof shipping valve, said valve comprising:

a. an integral top portion comprising an open-ended casing and a means for sealably connecting one end of said casing to an external dispensing means, the dispensing means including a check valve;

b. a break-away member comprising a base and a check valve releasing means thereon, said check valve releasing means extending toward said one end of the casing of the top portion, and said break-away member being positioned within said casing of said top portion and integrally connected to the inside of said casing through a break-away sealing surface, the sealing surface being rupturable, so as to permit separation of said break-away member from the inside of said casing, on connection of said one end of the casing to the external dispensing means;

c. an integral bottom portion comprising an open-ended casing; a means sealably connecting one end of said casing to an orifice of a shipping container; a stopping means for preventing said break-away member from falling into a connected shipping container after its separation from the casing of the top portion; and a means for positioning said check valve releasing means of the break-away member after its separation from the inside of the casing of the top portion so as to release the check valve of a connected external dispensing means; and d. an intermediate member integrally linking the other end of the top casing and the other end of the bottom casing, said connection maintaining a channel between the two portions.

12. In a combination of a disposable shipping container for holding fluids under pressure and an external dispensing means connected thereto, the external dispensing means including a check valve, a valve between a filling orifice of said disposable shipping container and said dispensing means, said valve comprising:

a. an integral top portion comprising an open-ended casing and a means thereon sealably connecting one end of said casing to said external dispensing means;

b. an integral bottom portion comprising an open-ended casing; a means thereon sealably connecting one end of said casing to said shipping container filling orifice; a stopping means for preventing a break-away member from falling into said shipping container; and a means for positioning the break-away member to release the check-valve of said dispensing means;

c. the break-away member comprising a base and a check-valve releasing means thereon, said base resting on said stopping means and said check-valve releasing means positioned by said positioning means to release the check-valve of said dispensing means; and d. an intermediate member integrally linking the unconnected end of the top casing and the unconnected end of the bottom casing, said connection maintaining a channel between the two casings.

* * * * *